United States Patent [19]

Kimura

[11] 4,142,361

[45] Mar. 6, 1979

[54] ELECTRO-OPTICAL DISPLAY TIMEPIECE

[75] Inventor: Satoshi Kimura, Tokorozawa, Japan

[73] Assignee: Citizen Watch Co. Ltd., Tokyo, Japan

[21] Appl. No.: 726,957

[22] Filed: Sep. 27, 1976

[30] Foreign Application Priority Data

Sep. 30, 1975 [JP] Japan ..... 50-117853

[51] Int. Cl.[2] ..... G04B 19/30

[52] U.S. Cl. ..... 58/50 R; 58/85.5; 58/39.5; 58/38 R

[58] Field of Search ..... 58/4 A, 23 R, 39.5, 58/50 R, 85.5, 155 R

[56] References Cited

U.S. PATENT DOCUMENTS 4,059,955 11/1977 Prak ..... 58/23 R

*Primary Examiner*—James R. Scott
*Assistant Examiner*—Vit W. Miska
*Attorney, Agent, or Firm*—Sherman & Shalloway

[57] ABSTRACT

An electro-optical display timepiece provided with a display changeover switch circuit manually controlled by a single external push button so that various displays including an alarm function display, chronograph function display and timer function display as well as time display may be obtained in accordance with the length of a time period, for which the push button is being continuously depressed.

10 Claims, 11 Drawing Figures

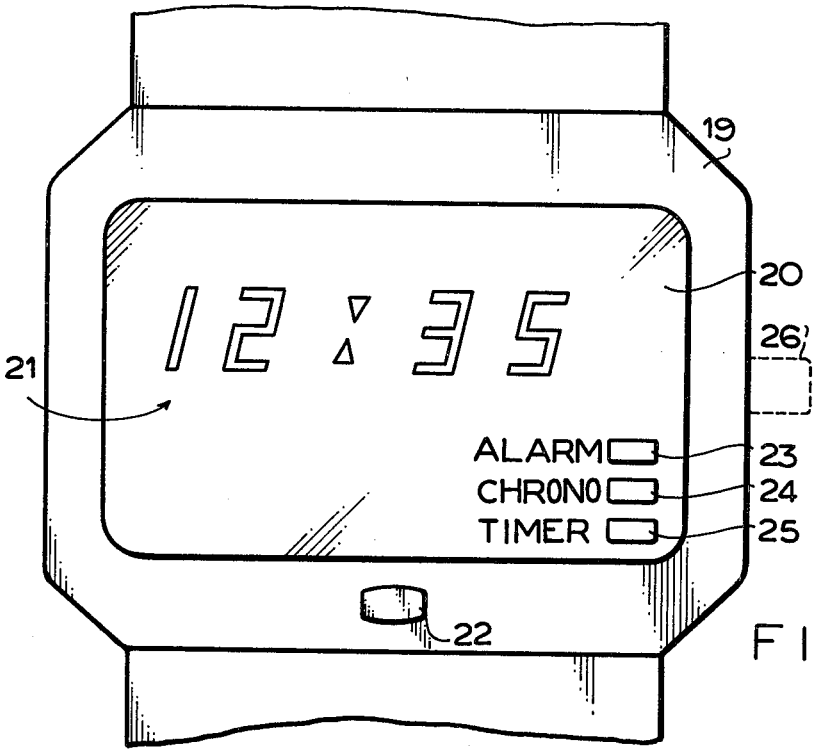
FIG. 5
FIG. 6
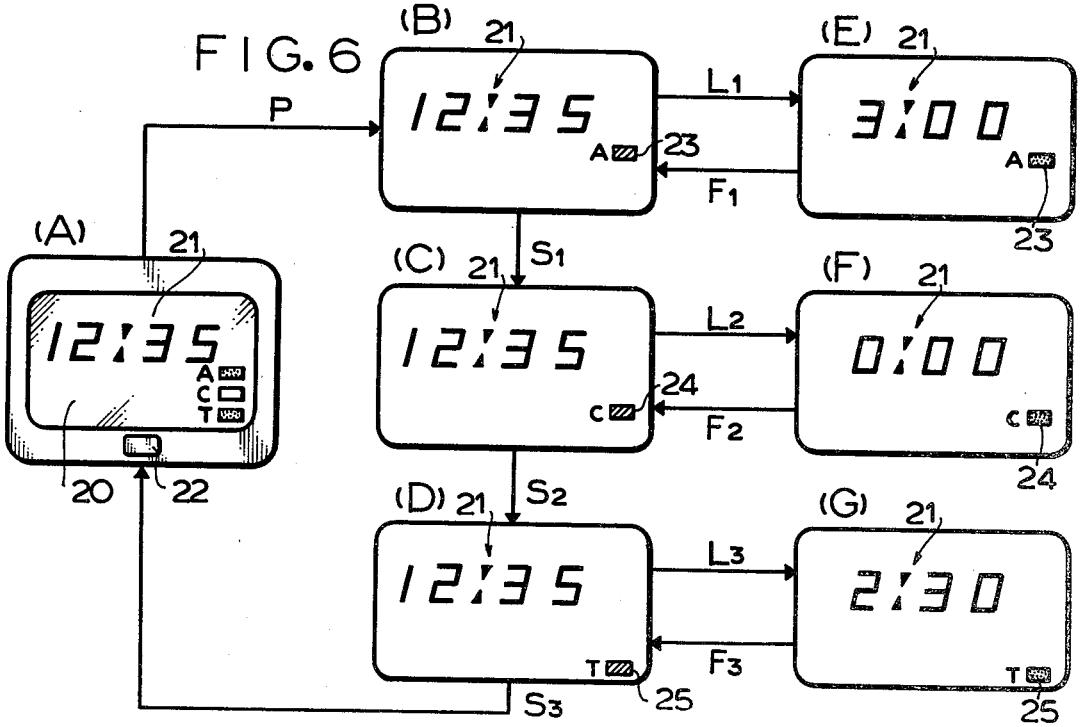

ELECTRO-OPTICAL DISPLAY TIMEPIECE

BACKGROUND OF THE INVENTION

1. Field of the Invention

This invention relates to an electro-optical display timepiece provided with a liquid crystal, light emission diode, etc. and having a display changeover switch circuit which changes over more than two different informations on the same display elements of the electro-optical timepiece. In greater detail, an electro-optical timepiece according to this invention is manually actuated by an external push button so that the different displays may be effected in accordance with the length of period, for which the push button is depressed continuously.

2. Description of the Prior Art

In the electronic timepieces having an electro-optical display, recently there have been provided ones with functions of displaying second, date or day of the week and the like as well as hour and minute. The displays of these timepieces having many functions are difficult to be discerned when all of the functions are displayed simultaneously on the same display part. In miniature timepieces such as wrist watches, the displays on the respective display surfaces tend to be extremely small. Therefore, it is required that the display functions of the timepieces having many functions are distributed to a plurality of blocks and that the whole or part of the display is displayed on the same display surface by means of display changeover means.

One of the conventional timepieces having such a changingover means is provided with a display changeover switch being externally actuated and its various kinds of displays are changed over after the termination of the operation of the display changeover switch. And there is one which, during the operation of the display changeover switch, effects the display different from that before the operation thereof and the after the termination of the operation of the switch, the display is returned to the same display as it was before the operation.

These conventional timepieces are ordinary and usual.

SUMMARY OF THE INVENTION

An object of the invention is to provide an electro-optical display timepiece having a display changeover switching circuit for changing over plural kinds of displays by the length of turning on a single display changeover switch.

Another object of the invention is to provide an electro-optical display timepiece having a display changeover switching circuit wherein the displays are different when the push button separates from a bearer's finger in dependence with the short or long time period of operating the switch.

Still a further object of this invention is to provide an electro-optical display timepiece having a display changeover switching circuit wherein the display in operation of the switch is different from that upon the returning of the switch when the time for operating the switch is shorter than the predetermined time and the display is not changed when the time for the operation of the switch is longer.

Still another object of this invention is to provide an electro-optical display timepiece having more than three kinds of informations, one of which is an ordinary display, and having a display changeover switching circuit wherein the short operation of the switch causes a part of the ordinary display to change so as to designate a destination, and the long operation causes the display to change to the designated display.

Still other objects and advantages of the invention will in part be obvious and will in part be apparent from the specification and the drawings.

BRIEF DESCRIPTION OF THE DRAWINGS

FIG. 5 is a plan view of a practical timepiece showing the second embodiment of this invention;

FIG. 6 is a schematic diagram showing displays changed over in the second embodiment of this invention;

DETAILED DESCRIPTION OF PREFERRED EMBODIMENTS

Figure 1:
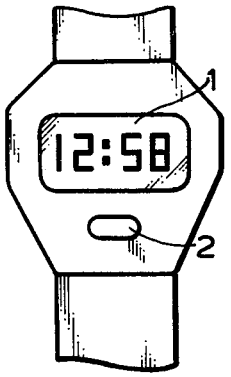
FIG. 1 is a plan view showing the first embodiment of a timepiece of the invention.

FIG. 1 shows an appearance of an electronic wrist watch of the first embodiment according to this invention, in which reference numeral 1 depicts a display surface in an electro-optical display device, 2 a display changeover switch composed of a push button for selectively changing over the display on the display surface 1. The display changeover switch 2 is operating during the depression of the push button.

Figure 2:
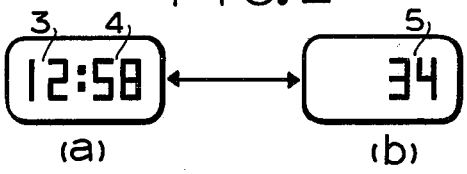
FIG. 2 is a schematic diagram showing the display changed over in the first embodiment.

FIG. 2 shows a display changeover system of the first embodiment according to this invention, which has display functions of hour, minute and second and imparts the display functions to a block for displaying hour and minute, and a block for displaying second only. FIG. 2 shows variations of the display surface 1 when the display is effected such that the part 4 ordinarly displaying minute is changed to second display 5.

Figure 3:
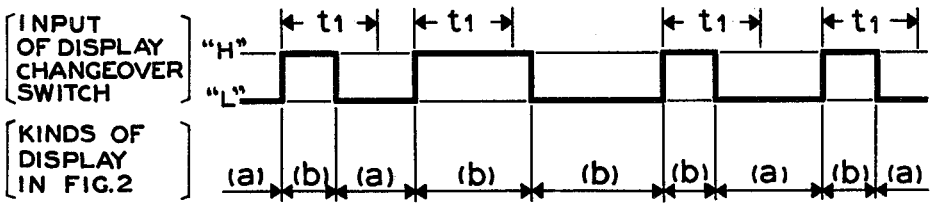
FIG. 3 is a timing chart showing the relation between an input of the display changeover switch and the variations of the display surface in the first embodiment.

FIG. 3 is a timing chart showing the relation between the changes of the display on the display surface 1 in FIG. 2 and the input of the display changeover switch 2 wherein, let the input of the switch 2 be at "H" (high) level during the operation of the switch 2 and be at "L" (low) level before and after the operation thereof.

The display (a) in FIG. 2 shows the display surface 1 on which hour digit 3 and minute digit 4 are displayed and the display (b) in FIG. 2 shows the display surface 1 on which only second digit is displayed. The display changeover operations will be described according to FIG. 3. Let the ordinary display state be the display state of the display (a) in FIG. 2. Firstly, if the switch 2 is operated for the length of a period shorter than the predetermined one, the input of the switch 2 becomes at "H" level during the operation of the switch 2 and thereby the display being the display (b) in FIG. 2. After the termination of the switch operation, the input becomes at "L" level and thereby to return the display to the initial state as shown by the display (a) in FIG. 2. Secondly, if the switch 2 is operated for a period being longer than the predetermined one, the display is keeping the display state as shown by the display (a) in FIG. 2 after the termination of the operation as well as during the operation. Therefore, it is not required to continue to depress the switch 2 since a second display can be discerned even if the switch is stopped to be depressed after the switch is depressed for a period longer than the predetermined period. In this state, the switch 12 is operated by a period shorter than the predetermined one $t_1$ so that the display may be returned to the display (a). Here, preferrencially the predetermined period is from 5 seconds to 10 seconds and so the feeling of the actuation is very good.

Figure 4:
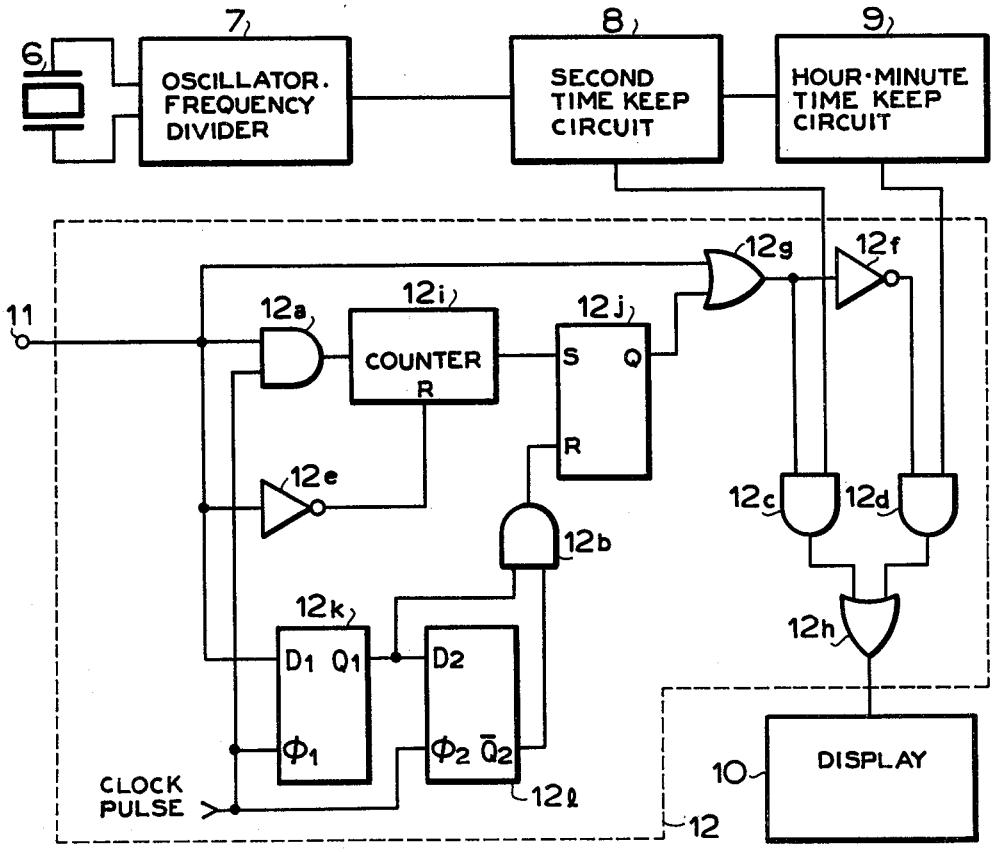
FIG. 4 is a block diagram showing the first embodiment of this invention.

FIG. 4 shows a display changeover circuit of the embodiment in FIG. 2, in which reference numeral 6 depicts a crystal oscillating element, 7 an oscillator and frequency divider circuit, 8 a time keep circuit for the second digit, 9 a time keep circuit for minute and hour digits, 10 an electro-optical display device displaying the contents in the time keep circuits 8 and 9, 11 a display changeover switch terminal receiving the input from the switch 2, 12 a brief part of a display changeover circuit selectively changing over the contents in the time keep circuits 8, 9 by the input from the display changeover switch terminal 11 and delivering them to the electro-optical display device 10. Reference numerals **12*a* to 12*d* illustrate AND circuits, 12*e* and 12*f* inverters, 12*g* and 12*h* OR circuits and 12*i* a counter circuit counting the predetermined period via AND circuit 12*a* by using appropriate frequency from the oscillator and frequency divider circuit 7, 12*j* a RS flip-flop circuit, 12*k* and 12l D type flip-flop circuits which generate a trigger pulse for a leading edge of the input signal from the display changeover switch terminal 11 together with AND circuit 12*b*. Therefore, since the input of the display changeover switch terminal 11 is kept at "H" level during the operation of the switch 2, the output from the OR circuit 12*g* becomes at "H" level so that the contents of the time keep circuit is delivered to the electrooptical display device 10 through AND circuit 12*c* and OR circuit 12*h* and as the result, the display surface 1 becomes the second display state as the display (b). In case that the operating period of the switch 2 is shorter than the predetermined period $t_1$, RS flip-flop circuit 12*j* is reset by a trigger pulse for a leading edge of starting the operation of the switch 2, the output Q is at "L" level, the input from the display changeover switch terminal 11 is also at "L" level so that the output from OR circuit 12*g* is at "L" level, the contents of the time keep circuit 9 is delivered through the inverter 12*f* and AND circuit 12*d* to the electro-optical display device 10 and as the result, the display surface 1 returns to the hour and minute display state like the display (a). On the other hand, in case that the switch 2 is operated for a period longer than the predetermined period, the pulse output is delivered from the counter circuit 12*i* after the lapse of the predetermined period $t_1$, RS flip-flop circuit 12*j* is kept at the set condition, the output Q is maintained at "H" level so that the output from OR circuit 12*g* may be kept at "H" level even if the input from the display changeover switch terminal 11** becomes at "L" level and as the result, the state of the display (b) is maintained.

Next, if the switch 2 is operated by the period shorter than the predetermined one $t_1$, RS flip-flop circuit **12*j* is reset by the trigger pulse for a leading edge of starting the operation, and thereby the output Q being at "L" level. Thus, the input from the display changeover switch terminal 11 becomes at "L" level after the termination of the operation of the switch 2 so that the output from OR circuit may also be at "L" level and as the result, the display surface 1** returns to the display state like the display (a).

Figure 7:
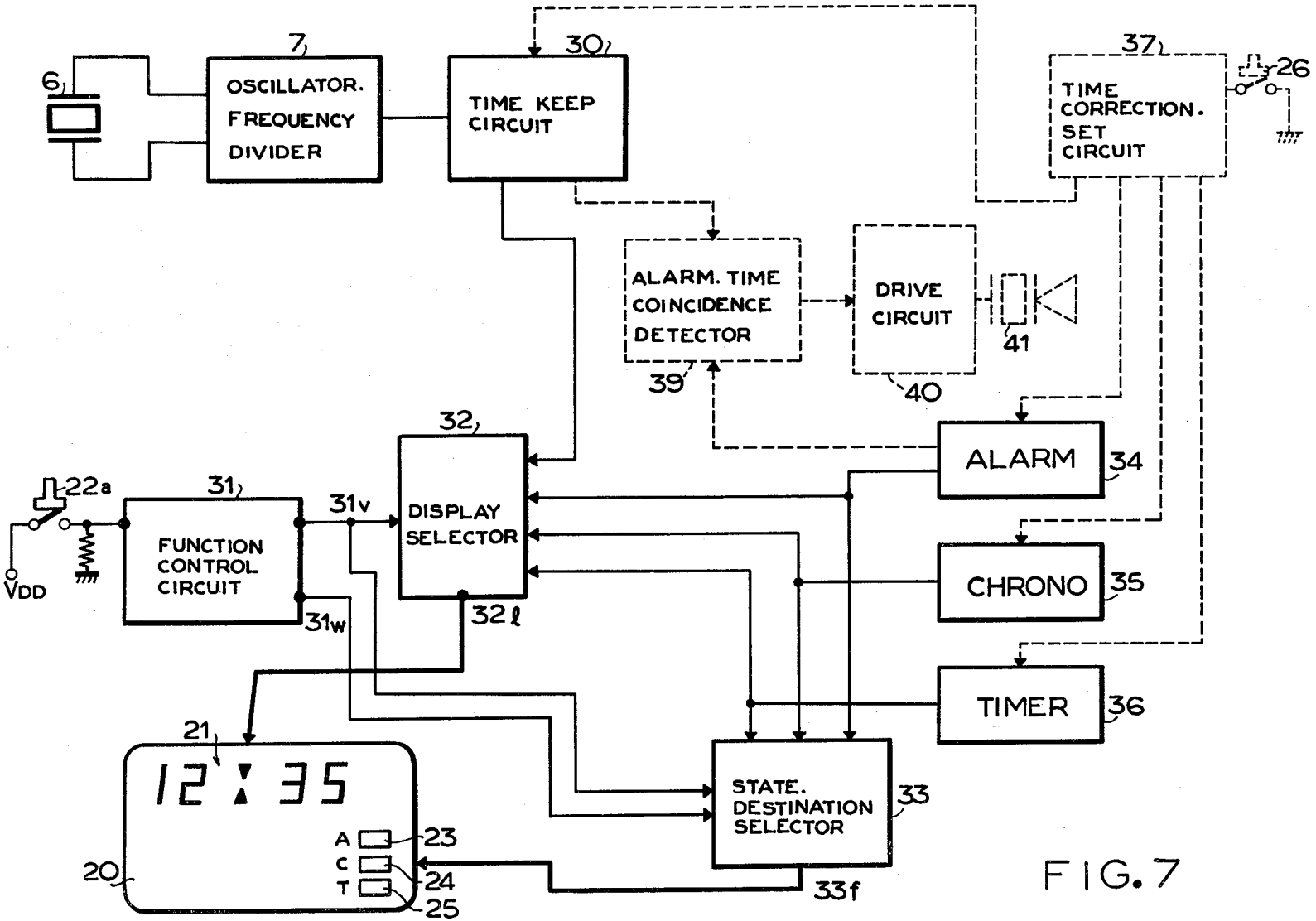
FIG. 7 is a block diagram showing the second embodiment of this invention.
Figure 8:
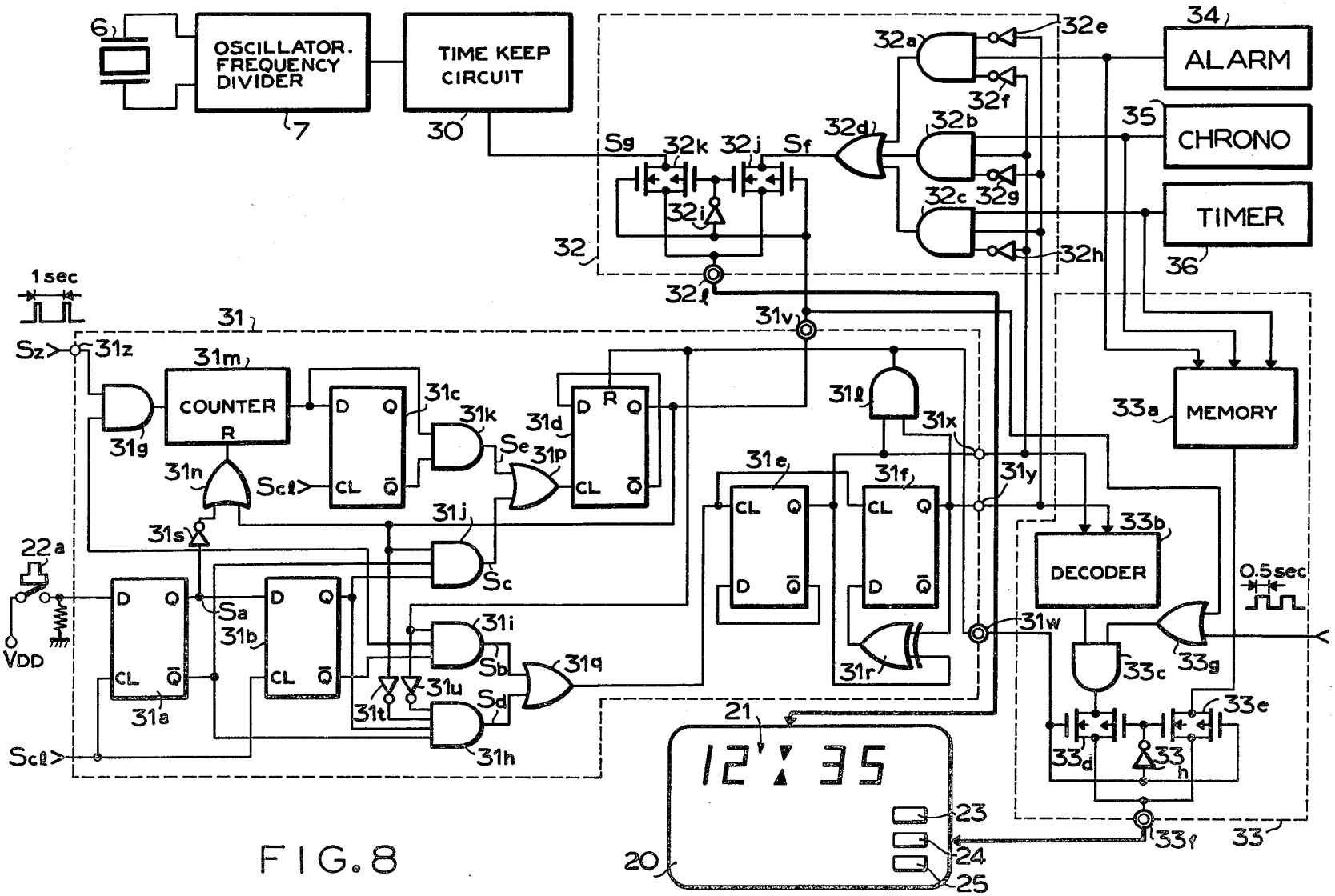
FIG. 8 is a detailed cricuit diagram showing the second embodiment of this invention.

FIGS. 5 through 8 show a timepiece of the second embodiment according to this invention, wherein FIG. 5 is a plan view of the timepiece, FIG. 6 is a schematic diagram showing the variations of the display in accordance with button actuations, FIG. 7 is a block diagram enabling the variations of the display in FIG. 6 and FIG. 8 is a practical circuit diagram. The timepiece of the second embodiment is a timepiece having various functions greater than those of the first embodiment in which each of the functions is selectively changed over in dependence upon the length of the period during the depression of the switch 2.

In FIG. 5, a timepiece has an alarm function, chronograph function and timer function. Its display surface 20 is provided with a main display part 21 selectively changing over and displaying each of the foregoing functions and function display parts 23 through 25 displaying the present displayed function on the main display part 21 and the function to be displayed next, i.e., destination.

A button 26 provided on the side of the timepiece 19 as shown by a dotted line is another actuating member for another operation, e.g., correction of the called out function or setting, etc. In the drawing, a single button is representatively shown, but necessary number of buttons may be provided, if necessary.

FIG. 6 is a schematic diagram showing how the various functions of the timepiece 19 in FIG. 5 change in accordance with the actuation of the button 22. The display (A) shows an ordinary time display which are present illustrates 12 hours 35 minutes on the main display part 21. If the button 22 is pushed under this condition, the display (A) is changed to the display (B) in the direction indicated by an arrow P. The display (B) is a destination indication on an alarm function while the ordinary time is still shown on the main display part 21, but an alarm function display 23 begins to flash. Under this condition, different function displays can be obtained by the operation of the button 22 according to the time period compared with the predetermined one, e.g., 5 through 10 seconds. When the button 22 is pushed during a period longer than the predetermined one, the display (B) is changed to the display (E) in a direction indicated by an arrow $L_1$. The display (E) shows an alarm function setting condition, an alarm time is displayed on the main display part 21 and the function display part 23 is always lightening. Under this condition, necessary alarm time setting and confirmation can be effected. On the other hand, the display (B) is changed to the display (C) in a direction indicated by an arrow $S_1$ if the button 22 is depressed by a period shorter than the predetermined one. The display (C) shows a destination designating condition to a chronograph function, an ordinary time is displayed on the main display part 21 and the chronograph function display part 24 flashes. The display (E) may be returned to the display (B) in an arrow $F_1$ by the actuation of a button 22 for a desired period.

Hereinafter, in the same manner, the display (C) is changed to the display (F) being a chronograph setting-condition in a direction indicated by an arrow $L_2$. If the swtich 22 is depressed for a period shorter than the predetermined one $t_1$, the display (C) is changed to the display (D) showing a destination designating condition toward the timer function in a direction indicated by an arrow $S_2$. Further, if the switch 22 is depressed for a period longer than the predetermined one, the display (D) is changed to the display (G) being a timer setting condition in a direction indicated by an arrow $L_3$. In addition, arrows $F_2$, $F_3$ illustrate the operation for a desired period of the button 22 returning each setting condition to the initial condition like the arrow $F_1$. An arrow $S_3$ shows the operation shorter than the predetermined one $t_1$ to make the display return to the display (A).

FIG. 7 is a circuit diagram of a timepiece enabling the operation of the second embodiment as set forth above, wherein reference numeral 6 depicts a crystal oscillating element, 7 an oscillator and frequency divider circuit, 30 a time keep circuit, 34 an alarm function circuit, 35 a chronograph function circuit, 36 a timer function circuit and 20 a display part. Various functions of the timepiece are selected by various actuations of the switch 22 so that the display surface 20 is varied to display each condition shown in FIG. 6.

This circuit mainly comprises a display selection circuit 32 which receives as an input the output 31*v* from the function control circuit 31 descriminating the depression and return of the push button 22 or the length of a time period in the operation of the push button 22, selects each of the alarm function circuit 34, chronograph circuit 35 and timer circuit 36 and delivers the output 32l to the main display part 21, and a state-destination selection circuit 33 which receives the outputs 31v and 31w from the function control circuit 31 as inputs and delivers the output 33f in response to each condition to each function display part 23, 24, 25 on the display surface 20. Of course, this timepiece has other necessary circuit constructions for example, time correction and setting circuit 37, the other actuation switch button 26, alarm and time coincidence detecting circuit 39, alarm producing body 41, a driving circuit 40 for the alarm sound body 41 and the other necessary circuits not shown. However, here, these circuit constructions are not explained since they are not concerned directly with the brief subject matter of this invention.

FIG. 8 shows a detailed embodiment of the circuit illustrated by a block diagram in FIG. 7 wherein like parts are shown by like references in FIG. 7 and the function control circuit 31, display selecting circuit 32 and statedestination selecting circuit 33 are enclosed with a dotted line respectively.

Firstly, the function control circuit 31 will be described. This circuit 31 comprises data type flip-flops 31*a*, 31*b*, 31*c*, 31*d*, 31*e*, 31*f*, AND gates 31*g*, 31*h*, 31*i*, 31*j*, 31*k*, 31l, a counter circuit 31*m* counting a pulse from an input terminal 31*z* to form the predetermined period, OR gates 31*n*, 31*p*, 31*q*, EXCLUSIVE-OR gates 31*r*, and inverters 31*s*, 31*t*, 31*u*. Thus, the circuit 31 serves to generate the outputs 31*v*, 31*w* and 31*x*, 31*y* for controlling the display selecting circuit 32 and state-destination selecting circuit 33 from the input signals of the pulse input 31*z*, clock pulse input cl and push button input. Speaking in greater detail, a signal S*a*making the pulse signal S*z* pass through the counter circuit 31*m* in the operation of the push button switch 22 by means of the flip-flop 31*a*, 31*b* and their ancillary circuit elements, a signal S*b* being delivered only the moment the push button switch 22 is depressed, a signal S*c* delivered when the push button switch 22 is depressed for a given period under the defined condition to be returned and a signal Sd delivered when the push button 22 is depressed for a period shorter than the predetermined one to be returned.

For example, the signal S*b* is used in order to change the display (A) to the display (B) in FIG. 6 and a quaternary counter of the flip-flop 31*e*, 31*f* is advanced by one. The content of the quaternary counter is shown concerning its outputs 31*x*, 31*y* as the following table:

TABLE I

| 31x | 31y | FUNCTION |
|---|---|---|
| H | H | TIME |
| L | L | ALARM |
| H | L | CHRONOGRAPH |
| L | H | TIMER |

This quaternary counter operates to vary the function display parts 23, 24, 25 without varying the main display part 21, is provided with AND gate 31l the output of which is at "H" level only in time display condition and which is connected to the output terminal 31*w* and thereby controlling the other circuit as mentioned afterward. Then, the counter circuit starts to count the input pulses with the aid of a signal S*a* delivering its output during the depression of the push button switch 22. Output of the flip-flop 31*d* delivering the output to change over the main display part 21 is inverted by a signal S*e* which is the counter output delivered, and, after a given count, changed into a pulse through the flip-flop 31*c* and AND gate 31*k*.

This output 31*v* is shown in the following table:

TABLE II

| 31v | MAIN DISPLAY |
|---|---|
| L | TIME |
| H | OTHER FUNCTIONS |

The changing conditions casued by the signal Sa correspond to the arrows $L_1$, $L_2$, $L_3$ in FIG. 6, respectively.

Next, in function display conditions, i.e., in each of the displays (E), (F), (G) in FIG. 6, the output of the flip-flop is inverted by the signal S*c* delivered when the push button switch 22 is depressed for a desired time to be returned afterwards so that the main display part 21 may be returned to the time display. The changing conditions carried by the signal S*c* correspond to the displays shown by the arrows $F_1$, $F_2$, $F_3$ in FIG. 6, respectively.

Further, in the condition that the main display part shows the time display and that the function display is called up, i.e., in the conditions of the displays (B), (C), (D) in FIG. 6, the signal S*d* is generated by the operation of the push button switch 22 which is shorter than the predetermined period, thereby stepping the quaternary counter comprising the flip-flops 31*e*, 31*f* and auxiliary circuit elements thereof to the next condition. The changing conditions caused by the signal Sd correspond to the arrows $S_1$, $S_2$, $S_3$ in FIG. 6, respectively.

Referring to the display selecting circuit 32, it comprises AND gates 32*a*, 32*b*, 32*c*, OR gate 32*d*, inverters 32*e*, 32*f*, 32*g*, 32*h*, 32*i* and transmission gates 32*j*, 32*k*.

The inputs of the display selecting circuit 32 are the outputs 31*v*, 31*x*, 31*y*. The circuit 32 is provided with various kinds of function circuits 30, 34, 35, 36 and with an output terminal 32l displaying one of the functions in the function circuits 30, 34, 35, 36 as its output. In the above explanation, each construction element is shown by one respectively, but it is clearly understood that practically each element is plural. In this construction, one of the function circuits 34, 35, 36 corresponding to the conditions of the outputs 31*x*, 31*y* from the function control circuit 31 is selected among a group of AND gates 32*a*, 32*b*, 32*c* and is derived as a signal S*f*. Further, one of the signal Sf and the signal S*g* from the time system is selected by the transmission gates 32*j*, 32*k* and driving the display part 21 as the output.

Referring to the state-destination selecting circuit 33, this circuit 33 comprises a setting and memory circuit 33*a*, decoder 33*b*, AND gate 33*c* transmission gates 33*d*, 33*e*, inverter 33*h* and OR gate 33*g*. This circuit 33 receives the output signals 31*x*, 31*y*, effects four kinds of remodulation based on the truth table of TABLE I at a decorder 33*b* therein. Further, under the conditions of the display (B), (C), (D) in FIG. 6, this circuit 33 operates to flash the defined one of the respective function display parts 23, 24, 25 through OR gate 33*g* and AND gate 33*c* by ON.OFF signals of 0.5 second from the exterior. Similarly, under the conditions of the display (E), (F), (G) in FIG. 6, it serves to light one of the display parts 23, 24, 25 ordinarily. The set and memory discriminating circuit 33*a* discriminates whether the function circuits 34, 35, 36 are now set or released and determines whether the function display parts 23, 24, 25 are to be lightened or extinguished. Then the circuit 33*a* discriminates the signals from the decorder system 33*b* (i.e., the conditions of the displays (B), (C), (D), (E), (F), (G) and those from the set and memory discriminating circuit system 33*a* (i.e., the condition of the display (A)) by means of the transmission gates 33*d*, 33*e*. Therefore, the foregoing timepiece with various functions also enables the easy changeover and control of the display by the time period of operating a single push button switch according to this invention.

Figure 9:
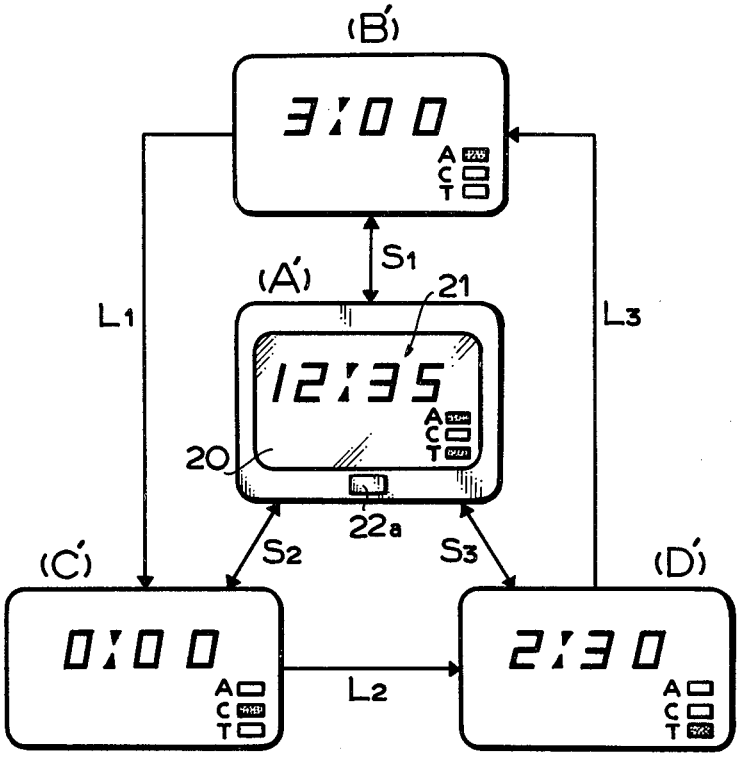
FIG. 9 is a schematic diagram showing a display changeover system of the third embodiment of this invention.
Figure 10:
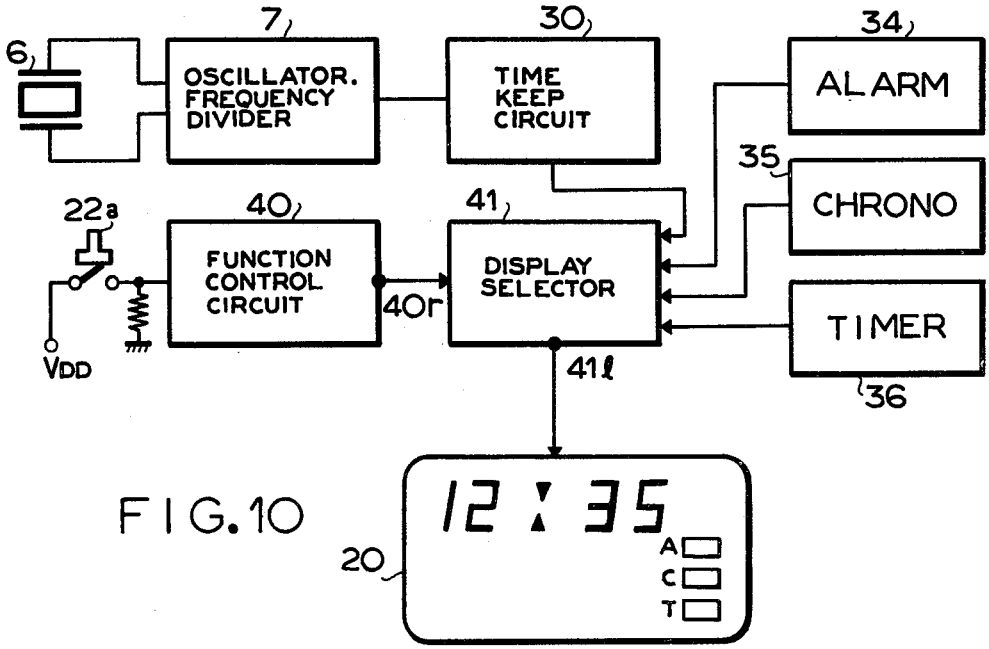
FIG. 10 is a block diagram showing the third embodiment of this invention.
Figure 11:
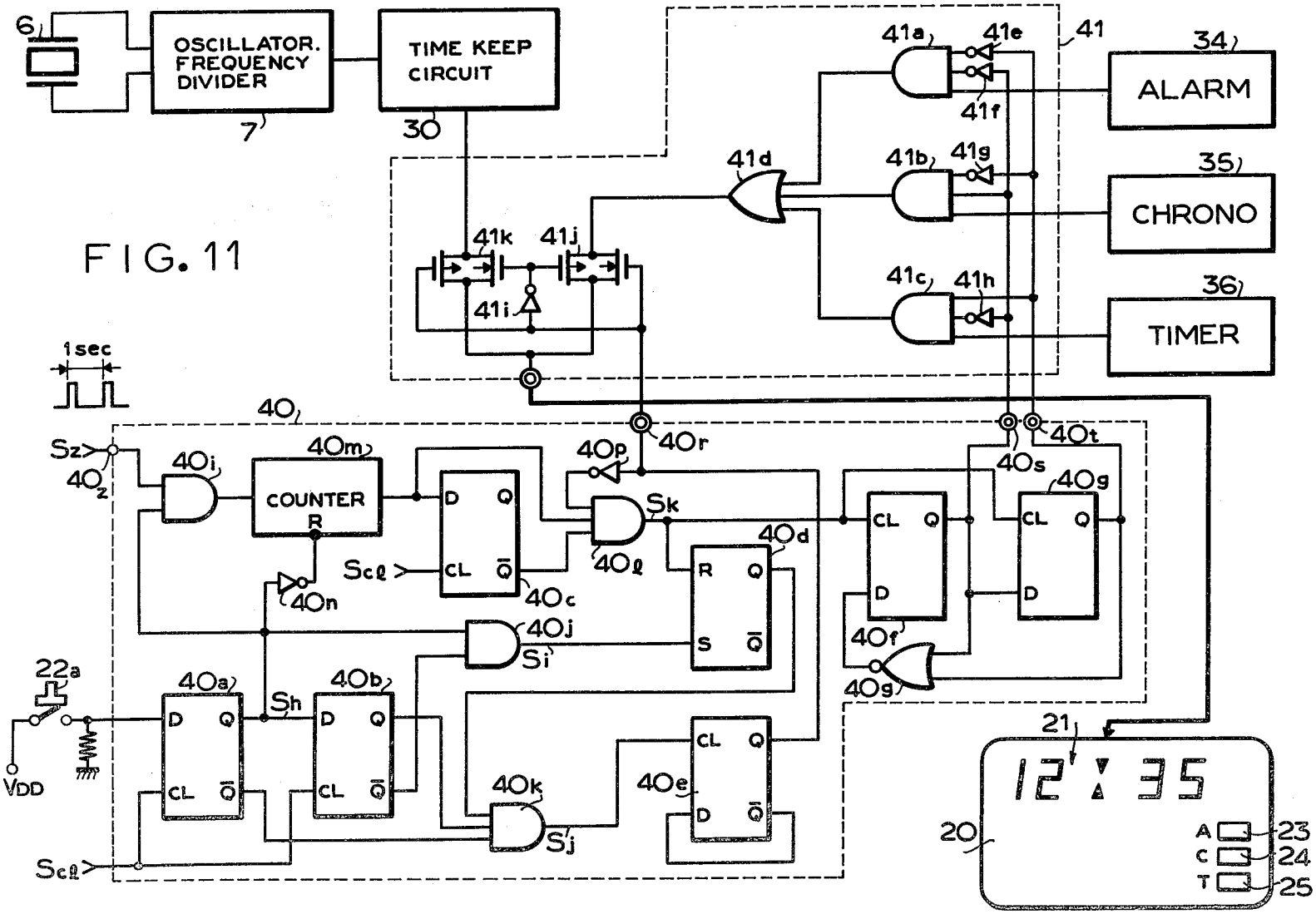
FIG. 11 is a detailed diagram showing the third embodiment of this invention.

FIGS. 9, 10, 11 show a timepiece of the third embodiment according to the invention, of which the appearance as a timepiece is similar to that of the second embodiment and so its view may be abbreviated. FIG. 9 is a schematic diagram showing changing conditions of the display in response to the switch operation of the push button 22*a*, FIG. 10 is a block diagram showing a practical circuit effecting the above various display conditions and FIG. 11 shows a detailed circuit. This third embodiment is attached importance to a time display function and is a modified one of the second embodiment.

In FIG. 9, the display (A′) indicates an ordinary time and shows 12 hours 35 minutes on the main display part 21 at the present time under this condition, the display (A′) is changed to the function display in accordance with the previous memory if the push button switch 22*a* is depressed for a period shorter than the predetermined one $t_1$. The display (A′) is changed to the display (B′) according to an arrow $S_1$ provided that the previous memory is the display (B′). The display (B′) shows an alarm function condition under which there is effected necessary alarm time setting and the confirmation or release of the set time.

Next, the changing conditions are different in dependence on a period of the depression of the push button switch 22*a*. The present display is changed again to the time display condition shown in the display (A′) according to an arrow $S_1$ if the time of the operation of the push button switch 22*a* is shorter than the predetermined one $t_1$. If the time of depressing the push button switch 22*a* is longer than the predetermined one $t_1$, the present display is changed to a chronograph condition shown by the display (C′) in accordance with an arrow $L_1$.

In the same manner, the display (C′) is changed to the display (A′) in accordance with an arrow $S_2$ if the time of depressing the push button switch 22*a* is shorter than the predetermined one $t_1$. If the pushing operation is longer, the display is changed to the timer function condition shown by the display (D′). Similarly, the display (D′) is changed to the display (A′) in accordance with an arrow $S_3$ if it is shorter and is changed to the display (B′) in accordance with an arrow $L_3$ if it is longer. In this case, the display (C′) showing a chronograph condition is changed to the display (A′) in accordance with an arrow $S_2$ and then the display (A′) is changed to the display (C′) showing a chronograph condition if the push button switch 22*a* is depressed shorter than the predetermined one $t_1$again.

FIG. 10 is a block diagram showing a brief circuit enabling the operation according to the third embodiment as set forth above, wherein reference numeral 6 depicts a crystal oscillating element, 7 an oscillator and frequency divider circuit, 30 a time keep circuit, 34 an alarm function circuit, 35 a chronograph function circuit, 36 a timer circuit, 20 a display part. And this circuit further comprises a function control circuit 40 descriminating whether the time of depressing the push button switch is longer or shorther than the predetermined one to deliver a control signal to a terminal 40*r*, display selecting circuit 41 selecting a defined one of the respective functions by the control signal to deliver a singal to the terminal 41l and a display part 20 displaying the selected content, etc. Of course, this circuit is provided with the other circuit elements like the second embodiment and then the other circuit elements are abbreviated.

FIG. 11 shows a detailed embodiment of a block diagram in FIG. 10 wherein like parts are depicted by like references, and the function control circuit 40 and display selecting circuit 41 are enclosed by a dotted line, respectively.

Referring to the furnction control circuit 40, reference numerals 40*a*, 40*b*, 40*c*, 40*e*, 40*f*, 40*g* illustrate data type flip-flop circuits, 40*d* RS flip-flop circuit, 40*i*, 40*j*, 40*k*, 40*l* AND gates, 40*m* a counter circuit counting the pulses from the input terminal 40*z* to form the predetermined period, 40*n*, 40*r* inverters and 40*q* NOR respectively. In this circuit connections, a pulse input 40*z*, clock pulse Cl and the signal of the push button switch 22*a* operate to deliver the outputs 40*r*, 40*s*, 40*t* controlling a display selecting circuit 41.

In greater detail, the flip-flop circuits 40*a* and 40*b* and ancillary circuits thereof generate a signal S*h* making the pulse 40*z* pass through the counter 40*m* in the operation of the push button switch 22*a*, a signal Si delivered only the moment the puch button switch 22*a* is depressed, and a signal S*j* delivered when the time of depressing the push button switch 22*a* is shorter than the predetermined period. Therefore, the signal S*j* provides the depressing operations for a short time indicated by the arrows $S_1$, $S_2$, $S_3$ in FIG. 9. Namely, the signal S*j* operates the flip-flop 40*e* to keep the output at "H" or "L" level. The output from the flip-flop 40e controls the display selecting circuit 41 to select the time display condition in case of "H" level or to select the function display conditions in case of "L" level. While with the aid of the signal S*h* transmitting during the depression of the push button switch 22a, the counter circuit 40m starts to count the inputs, and the flip-flop 40c and AND gate 40l change the output delivered after the defined count into a pulse signal S*k* so that the ternary counter briefly composed of the flip-flops 40f, 40g may be stepped. The countents of the counter is as the following table in point of its outputs 40s, 40t.

TABLE III

| 40s | 40t | FUNCTION |
|---|---|---|
| L | L | ALARM |
| H | L | CHRONOGRAPH |
| L | H | TIMER |

This table shows that each mode corresponds to one of the arrows $L_1$, $L_2$, $L_3$ in FIG. 9 wherein the function display (A') is changed in turn to the displays (B'), (C'), (D'), (B') . . . without the display (A'). The function modes may be changed n times if the time of depressing the push button switch 22a is n times of the predetermined period. The signal S*i* generated the moment the push button switch 22a is depressed is an auxiliary signal to operate the circuit in preciseness and control RS flip-flop 40d to prevent an erroneous operation.

Next, the display selecting circuit 41 is almost similar to the display selecting circuit 32 of the second embodiment in FIG. 8 and then the explanation will be given simply. Reference numerals 41a, 41b, 41c depict AND gates, 41a OR gate, 41e, 41f, 41g, 41h, 41i inverters, 41j, 41k transmission gates. The display selecting circuit 41 is controlled by the output terminals 40r, 40s, 40t so that one of the time function circuit 30, alarm function circuit 34, chronograph function circuit 35 and timer function circuit 36 may be selected and as the result, the display surface 20 is driven as shown in FIG. 9. The third embodiment is suitable for the case that the function of the time display frequently used ordinarily is mainly utilized.

As described hereinbefore, this invention provides a timepiece whose displays a bearer can easily change by the time length of a push button operation as occasion demands. Therefore, the timepiece of this invention does not require two separate switches which the conventional timepieces require to obtain various kinds of function displays and is provided with a single push button therefor. In addition, the increase of circuit elements is a little, and the increase of circuit terminals and switch terminals is not necessary.

What is claimed is:

1. An electro-optical display timepiece comprising:

(a) a crystal oscillating element having an output signal;

(b) a frequency divider connected to said crystal oscillating element for dividing the output signal;

(c) a counter circuit including at least a time keep circuit counting an output signal from said divider so as to deliver a time keep signal;

(d) a display means for displaying at least one kind of time information;

(e) a display changeover circuit connected between said counter circuit and said display means for providing signals to said display means;

(f) a switch externally operable and operating said changeover circuit;

(g) said display changeover circuit including changeover means changing over said display means from a first display to a second display in response to an ON signal from said switch;

(h) a timer circuit for providing an output signal when said switch is held ON for more than a predetermined time;

(i) memory means for memorizing existence or non-existence of said output signal from said timer circuit; and (j) a display circuit for operating said changeover means to send signals to said display means to display said second display while said memory means memorizes said timer signal, whereby the instant when said switch is turned ON, said first display is changed to said second display, and if said ON state is held longer than said predetermined time, then said second display is displayed after said switch is turned OFF, and if said ON state is held shorter than said predetermined time, then said first display is displayed after said switch is turned OFF.

2. An electro-optical display timepiece as claimed in claim 1 wherein said display changeover circuit further comprises memory means for memorizing existance or non-existance of said timer signal, and a display circuit operating said changeover means to display said other dispaly while said memory means memorizes said timer signal.

3. An electro-optical display timepiece as claimed in claim 2 wherein said display changeover circuit further comprises a clearing circuit clearing said memory means whenever there exists an ON signal from said switch.

4. An electro-optical display timepiece as claimed in claim 3 wherein said other display comprises a mark for indicating any of said plural functions, and said changeover means is provided separately from said changeover means.

5. An electro-optical display timepiece as claimed in claim 4 wherein said display changeover circuit further comprises a counter designating any of said plural functions, an input of said counter being connected to a gate circuit which at first counts the leading edge of said ON signal from said switchand then counts the trailing edge of said ON signal from said switch.

6. A circuit for use in a portable multi-information apparatus including a first information forming circuit, a plurality of second information forming circuits, an electro-optical dispaly device driven by said first and second information forming circuits, a changeover circuit connecting one of said information forming circuits to said display device, circuit means for cyclically designating any of said second informations in a predetermined order, and an externally operable switch, a first circuit transmitting a first signal when said switch is ON for more than a predetermined period and a second circuit transmitting a second signal when said switch is OFF within the lapse of the predetermined period after said switch turns ON, memory means discriminating either of said first and second signals transmitted to memorize the operation mode of said first and second signals whereby said first signal transmitted operates said changeover circuit, said second circuit advancing said circuit means designation in the predetermined order and said memory means memorizing the condition.

7. A circuit for use in a portable multi-informaton apparatus as claimed in claim 6, wherein said second information forming circuits are comprised of an alarm, chronograph and timer.

8. A calling up circuit for use in a portable multi-information apparatus as claimed in claim 7 wherein said first information is time.

9. A calling up circuit for use in a portable multi-information apparatus as claimed in claim 8 wherein said second informations are an alarm, chronograph and timer.

10. In a multi-information electro-optical display timepiece having an "ON-OFF" single position switch controling the display, said timepiece having a means for displaying a primary informaton which is normally displayed, said timepiece further having a plurality of secondary informations which may be selected for display by actuation of the switch, the improvement comprising:

(a) means for displaying one of said secondary informations when said switch is turned "ON";

(b) means for displaying one of said secondary informations when said switch is turned "OFF" after being turned "ON" and held "ON" for more than a predetermined period of time; and (c) means for displaying the primary information when said switch is turned "OFF" after being turned "ON" and held "ON" for less than the predetermined period of time.

* * * * *